US005143634A

United States Patent [19]

Quinga et al.

[11] Patent Number: 5,143,634

[45] Date of Patent: Sep. 1, 1992

[54] ANTI-WEAR ENGINE AND LUBRICATING OIL

[75] Inventors: Elaine M. Quinga, Batavia; Luke A. Schaap, South Holland, both of Ill.

[73] Assignee: Amoco Corporation, Chicago, Ill.

[21] Appl. No.: 642,465

[22] Filed: Jan. 17, 1991

[51] Int. Cl.[5] ..... C10M 141/02

[52] U.S. Cl. ..... 252/33; 252/39; 252/46.4; 252/47; 252/50

[58] Field of Search ..... 252/51.5 R, 50, 46.3, 252/46.4, 33, 39, 42.7, 47

[56] References Cited

U.S. PATENT DOCUMENTS 4,298,481 11/1981 Clarke ..... 252/21
4,507,215 3/1985 Schroeck ..... 252/35

FOREIGN PATENT DOCUMENTS 2071139 9/1961 United Kingdom .
1061904 3/1967 United Kingdom .

OTHER PUBLICATIONS

Japanese 60-194087-A Abstract, Feb. 10, 1985.

*Primary Examiner*—Margaret Medley
*Attorney, Agent, or Firm*—Thomas A. Yassen; William H. Magidson; Frank J. Sroka

[57] ABSTRACT

An engine and lubricating oil having superior anti-wear properties without necessitating use of phosphorus-containing anti-wear additives is provided which is particularly useful in automotive, industrial, and gear lubricants. The anti-wear engine and lubricating oil comprises an anti-wear component including benzotriazole or the reaction product of benoztriazole, combined with a formaldehyde-containing component and at least one primary or secondary aliphatic amine, a sulfur-containg compound, a metallic component, and a lubricating base oil.

25 Claims, 1 Drawing Sheet

ANTI-WEAR ENGINE AND LUBRICATING OIL

BACKGROUND OF THE INVENTION

This invention relates to an engine and lubricating oil with superior anti-wear properties which reduces air pollution by prolonging automobile catalytic converter life. More particularly, this invention relates to an anti-wear engine and lubricating oil which includes benzotriazole or the reaction products of benzotriazole with a stream comprising formaldehyde and an aliphatic amine, a sulfur-containing compound, and a metallic component.

Considerable work has been done with lubricating oils, mineral and synthetic, to enhance their anti-wear properties by modifying them with suitable additives. The use of lubricant anti-wear additives containing phosphorus has been well documented and widely implemented commercially. These additives include acid phosphates, phosphites, phosphonates, phosphate esters, metallic dithiophosphates, and the like.

Of the commercially successful phosphorus-containing lubricant anti-wear additives, zinc dialkyldithiophosphate (ZDDP) has been among the most commonly used. It is generally considered that ZDDP functions by forming a metal protective film of sulfide and phosphate decomposition products in boundary contact with the metal surfaces, thereby providing wear protection. In addition to anti-wear properties, ZDDP can also provide anti-oxidant capabilities.

While phosphorus-containing anti-wear additives do enhance engine and lubricating oil anti-wear performance, they also can contribute to reduced environmental air quality by adversely affecting automobile emissions systems. Automobile emissions systems generally comprising catalytic converters were developed to address air quality concerns and comply with legislation controlling vehicular emissions. Catalytic converters generally include precious metal oxidation catalysts and operate to facilitate the combustion of fuel to carbon dioxide and water while minimizing the products of incomplete combustion.

Catalytic converter performance generally deteriorates over time and often occurs as a consequence of chemical poisoning and physical deterioration. Lead and lubricant derived phosphorus, mainly from phosphorus anti-wear additives, have been identified as the primary catalyst poisons.

Phosphorus-containing lubricating oils can reach the automobile emissions systems in several ways. Oil can reach the combustion chamber through inlet valve guide leakage, turbocharger compressor seal leakage, and bypassing of the piston rings. Once combustion takes place, phosphorus-containing components are carried with the combustion flue gas to the emissions system where the phosphorus component can poison the catalytic converter catalyst.

While lead contamination will be substantially reduced with the complete phase out of lead from gasoline, phosphorus anti-wear additives are not being phased out of engine and lubricating oils. Phosphorus levels have been minimized to balance automobile manufacturer anti-wear requirements with catalytic converter life, but still are present due to lack of an adequate substitute for phosphorus-containing anti-wear additives.

Thus, a need exists to provide an engine and lubricating oil that provides superior anti-wear properties, consistent with the requirements of modern high performance engines, while not damaging emissions systems. While there exists a great need for such a composition, the art has been devoid of teachings and solutions, and automobile manufacturers and lubricating oil suppliers have continued with use of phosphorus-containing lubricating oils. This need may escalate if automakers are required to increase their emissions systems warranty period.

Benzotriazole and alkylbenzotriazole have been used commercially as corrosion and discoloration inhibitors for copper and copper alloys. In particular, benzotriazole is widely used in antifreeze, brake fluids, anticorrosion oils, electrical wires, copper products, coatings, photographic waxes, and cleaners. Various patents teach the use of benzotriazole compounds in industrial and gear oils.

British Patent No. GB 2,071,139 discloses an anti-staining compound including benzotriazole mixed directly with an aliphatic amine and a sulfurized aliphatic or alicyclic olefinic component for use in industrial and gear oils. The benzotriazole and aliphatic amine forms an organic salt that primarily minimizes additive side effects such as the staining of copper parts.

While benzotriazole and alkylbenzotriazole have found numerous commercial uses, their solubility characteristics limit these materials from other uses. Benzotriazole and alkylbenzotriazole are quite soluble in polar solvents such as methyl alcohol, acetone, and ethylene glycol, but only slightly soluble in benzene, toluene, xylene, and lubricating oil base stocks. The combination of benzotriazole or alkylbenzotriazole with an aliphatic amine alone, as described in British Patent No. GB 2,071,139, can produce an organic salt with limited solubility in lubricating oil base stocks. Benzotriazole and alkylbenzotriazole-containing organic salts, when alone, can "drop out" of conventional lubricating oil base stocks and are not widely used commercially.

Other patents teach methods to improve the solubility of benzotriazole or alkylbenzotriazole in engine and lubricating oils by creating a benzotriazole or alkylbenzotriazole structure that is non-ionic.

British Patent No. GB 1,061,904 discloses a compound made from the Mannich reaction of benzotriazole or alkylbenzotriazole, formaldehyde, and dialkylamines. The Mannich reaction compound exhibits improved solubility in lubricating oil base stocks and additional metal passivation properties.

Japanese Patent No. SHO 60 [1985]-194087 discloses a compound made from the Mannich reaction of benzotriazole or alkylbenzotriazole, an aldehyde, and a primary or secondary amine. The compound exhibits improved solubility in lubricating oil base stocks and additional properties for prevention of corrosion and the discoloration of metals.

It is therefore an object of the present invention to provide an engine and lubricating oil with superior anti-wear properties.

It is another object of the present invention to provide an engine and lubricating oil with high solubility in lubricating oil base stock.

It is yet another object of the present invention to provide an engine and lubricating oil that does not require a phosphorus-containing anti-wear additive.

SUMMARY OF THE INVENTION

The above objects can be attained by providing an anti-wear engine and lubricating oil including a base oil; an anti-wear component having at least one member selected from the group consisting of benzotriazole and the reaction products of benzotriazole, with a component comprising formaldehyde and at least one aliphatic amine selected from the group consisting of primary and secondary amines; a sulfur-containing compound; and a metallic component having at least one member selected from the group consisting of calcium, magnesium, strontium, and barium.

The anti-wear engine and lubricating oil is particularly suitable for use in motor oil lubricants for spark-ignited and compression-ignited internal combustion engines, including truck and automobile engines, two-cycle engines, aviation piston engines, marine and railroad diesel engines, and the like. The engine and lubricating oil can also be used in gas engines, stationary power engines, turbines, and the like. Automatic transmission fluids, transaxle lubricants, gear lubricants, metal-working lubricants, hydraulic lubricants, and other lubricating oil and grease compositions can also benefit from the superior anti-wear properties of the engine and lubricating oil of the present invention.

The anti-wear engine and lubricating oil of the present invention provides anti-wear performance superior to that of lubricating oils having conventional phosphorus-containing anti-wear components. The engine and lubricating oil maintains high solubility in lubricating oil base stocks minimizing additive "drop out," which can occur with low solubility additives. Moreover, the lubricating oil of the present invention does not cause deterioration of automobile emissions system devices, as can phosphorus-containing anti-wear lubricating oils, and can result in reduced pollutant emissions, especially in older automobiles. The engine and lubricating oil is also cost effective to manufacture.

The anti-wear engine and lubricating oil of the present invention provides the solution to the long standing need for an engine and lubricating oil with superior anti-wear properties that does not cause deterioration to automobile emissions systems.

A more detailed explanation is provided in the following description and appended claims.

DETAILED DESCRIPTION OF THE INVENTION

Figure 1:
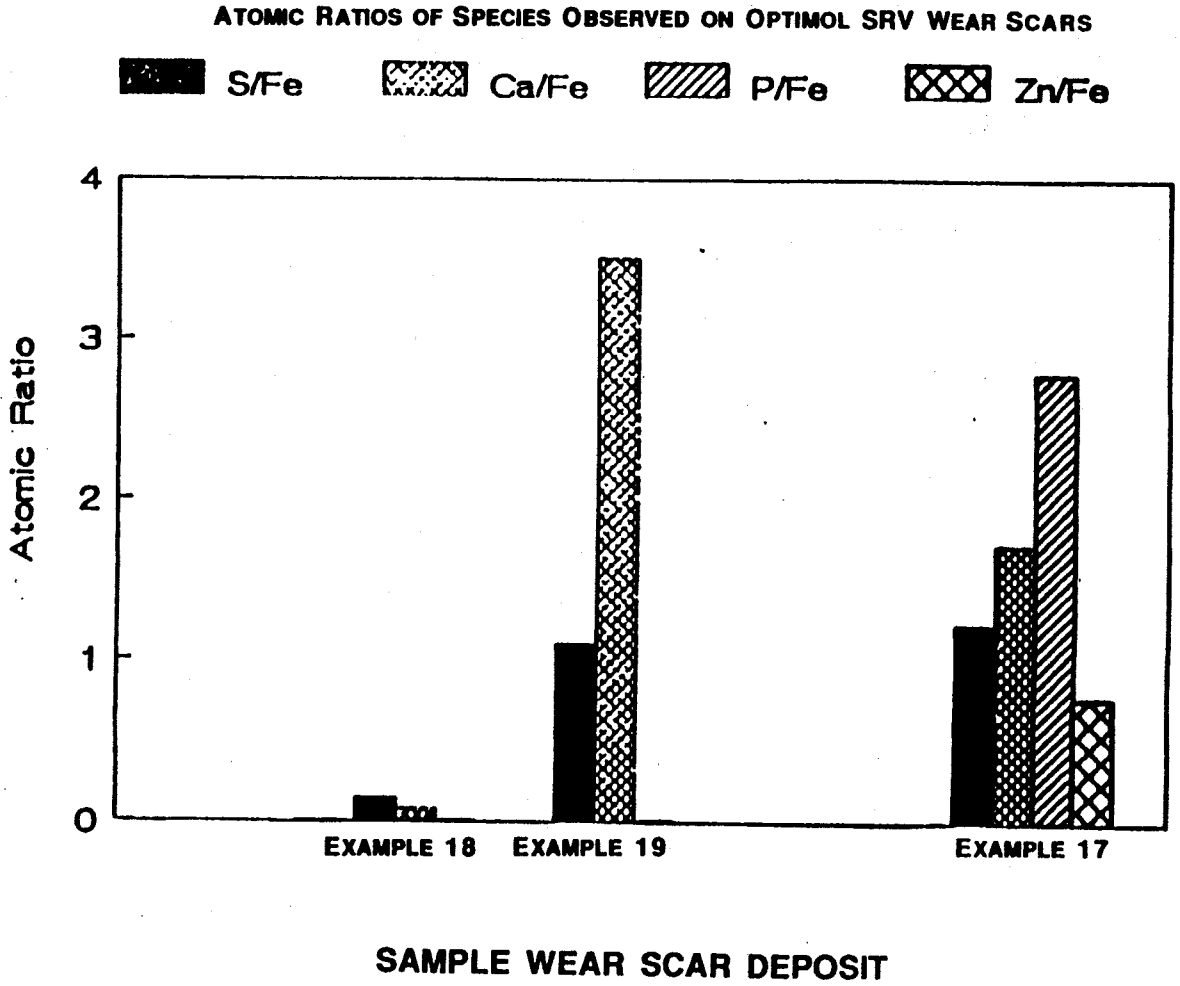
FIG. 1 is a graph illustrating the atomic ratios of sulfur to iron, calcium to iron, phosphorus to iron, and zinc to iron for the engine and lubricating oil of the present invention, an engine and lubricating oil having ZDDP, and an engine and lubricating oil without an anti-wear additive.

An engine and lubricating oil having superior anti-wear properties without necessitating use of phosphorus-containing anti-wear additives is provided which is particularly useful in automotive, industrial, and gear lubricants. The anti-wear engine and lubricating oil comprises an anti-wear component including benzotriazole or the reaction products of benzotriazole, combined with a formaldehyde-containing component and at least one primary or secondary aliphatic amine, a sulfur-containing compound, a metallic component, and a base oil.

The anti-wear component of the engine and lubricating oil of the present invention is produced from the Mannich reaction of benzotriazole or the reaction products of benzotriazole with formaldehyde and at least one primary or secondary aliphatic amine. The Mannich reaction can be represented by the formula

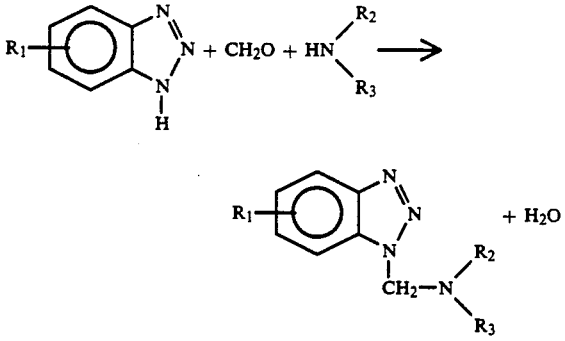

where $R_1$ can be hydrogen, alkyl, hydroxy, alkoxy, halo, nitro, carboxy, and carbalkoxy, and $R_2$ and $R_3$ can be hydrogen or monovalent aliphatic groups having from 1 to 30 carbon atoms. $R_2$ and $R_3$ are generally not both hydrogen.

The benzotriazoles used in the anti-wear component can be substituted or unsubstituted benzotriazoles wherein the substituents can be, for example, hydrogen, alkyl, hydroxy, alkoxy, halo, nitro, carboxy, and carbalkoxy. Suitable benzotriazoles are benzotriazole, tolylbenzotriazole, 4-methylbenzotriazole, chlorobenzotriazole, nitrobenzotriazole, carboxybenzotriazole, methylbenzotriazole, and mixtures thereof. The preferred benzotriazoles are benzotriazole and the alkylbenzotriazoles in which the alkyl group contains from about 1 to about 20 carbon atoms and more preferably from about 1 to about 8 carbon atoms. Alkyl groups containing from about 1 to about 8 carbon atoms can provide enhanced solubility properties. The most preferred benzotriazoles are benzotriazole, tolylbenzotriazole, 4-methylbenzotriazole, 5-methylbenzotriazole, and mixtures thereof. Benzotriazoles, with the alkyl group in the 4 or 5 positions (IUPAC) can provide increased reactivity with the formaldehyde-containing component and the primary or secondary aliphatic amine.

The aliphatic amines used in the anti-wear component can be monoamines or polyamines, with monoamines being preferred. The aliphatic amines can be primary or secondary. Tertiary amines are not preferred since they may not be reactive with the benzotriazole or reaction products of benzotriazole in the Mannich reaction.

Polyamines suitable for use in the anti-wear component can be ashless dispersants containing polyamines such as tetraethylenepentaamine and triethylenetetraamine. These components are generally functionalized by reaction with a polymer succinic anhydride or with an alkylated phenol and an aldehyde in a Mannich reaction.

Primary amines suitable for use in the anti-wear component preferably have an alkyl group containing more than 7 carbon atoms. More preferably, the primary amine contains a tertiary alkyl group having from about 10 to about 30 carbon atoms. Illustrative amine mixtures of this type are Primene 81R, manufactured by Rohm & Haas Co., which is a mixture of $C_{12-14}$ tertiary alkyl primary amines and Primene JM-T which is a similar mixture of $C_{18-22}$ amines.

Secondary amines having the formula $HNR_1R_2$ wherein $R_1$ and $R_2$ independently represent a linear or branched alkyl group having from about 4 to about 18 carbon atoms, a cycloalkyl group, or a cycloalkyl group having a hydrocarbon side chain with at least 2 carbon atoms are suitable for use in the anti-wear component. Linear or branched alkyl groups having less than 4 carbon atoms can have lower solubility in mineral or synthetic engine and lubricating base oil while linear or branched alkyl groups with more than 18 carbons atoms can have reduced anti-wear activity.

The formaldehyde-containing stream used in the anti-wear component can be pure, dilute, or in mixture with other components. Formalin, a dilute formaldehyde component, is suitable for use in the anti-wear component Mannich reaction.

It is preferred that the formaldehyde be added in a sufficient amount to minimize the reaction of the benzotriazole or reaction products of benzotriazole directly with the primary or secondary aliphatic amine. This direct reaction of benzotriazole or the reaction products of benzotriazole with a primary or secondary aliphatic amine can produce organic salts which can exhibit poor solubility characteristics in engine and lubricating base oils. The formaldehyde and benzotriazole or reaction products of benzotriazole can also be combined in an amount exceeding the molar equivalents necessary to consume the primary or secondary aliphatic amine since unreacted portions of these components are more easily removed from the mixture.

The reaction products of the Mannich reaction of benzotriazole or the reaction products of benzotriazole with a formaldehyde-containing stream and a primary or secondary aliphatic amine are preferably present in the engine and lubricating oil in an amount of from about 0.1 percent by weight to about 4 percent by weight, preferably from about 0.1 percent by weight to about 2 percent by weight, and more preferably from about 0.5 percent by weight to about 1.5 percent by weight. Compositions having less than 0.1 percent by weight of the anti-wear component, when combined with the sulfur-containing compound and the metallic component, can provide reduced wear resistance. Compositions having over 4 percent by weight of the anti-wear component can be less cost effective to manufacture.

The sulfur-containing compound of the engine and lubricating oil of the present invention can include sulfurized oxidation-inhibiting agents such as the products of the sulfurization reaction of olefinic compounds, organic sulfides, and polysulfides. Examples of these sulfur-containing compounds are dibenzyl disulfide, bis (chlorobenzyl) disulfide, dibutyltetrasulfide, sulfurized methyl ester of oleic acid, sulfurized fatty esters and glycerides, sulfurized alkylphenol, sulfurized dipentene, and sulfurized terpene.

The sulfur-containing compound of the engine and lubricating oil of the present invention can include phosphorosulfurized hydrocarbons. Suitable phosphorus-containing sulfurized compounds include phosphorus-containing products of the sulfurization reaction of olefinic compounds, organic sulfides, and polysulfides such as the reaction product of phosphorus sulfide with turpentine or methyl oleate; metal thiocarbamates such as zinc dioctyldithiocarbamate and barium heptylphenyldithiocarbamate; and the Group II metal phosphorodithioates such as zinc dicyclohexylphosphorodithioate, zinc dioctylphosphorodithioate, barium di(heptylphenyl) phosphorodithioate, and the zinc salt of a phosphorodithioic acid produced by the reaction of phosphorus and pentasulfide with an equimolar mixture of isopropyl or butyl alcohol and higher alcohols. However, the presence of phosphorus in engine and lubricating oils containing phosphorosulfurized hydrocarbons can reduce emissions system life in automotive use.

The preferred sulfur-containing compounds are the sulfurized olefinic compounds having from about 3 to about 30 carbon atoms and more preferably from about 3 to about 20 carbon atoms. The olefin used in the sulfur-containing compound provides an extended molecular chain which increases the solubility of the compound in the engine and lubricating oil. The preferred olefinic sulfur-containing compound includes an olefin defined by the formula $R_1R_2=R_3R_4$ where $R_1$, $R_2$, $R_3$, and $R_4$ can be hydrogen, alkyls, or alkenyls. The centrally located double bond is preferred in the olefin of the sulfur-containing compound since it can provide better reactivity with the sulfur containing molecule. An illustrative sulfur-containing compound of this type is AMOCO 130 manufactured by Amoco Petroleum Additives Company.

The sulfur-containing compound is preferably present in the engine and lubricating oil of the present invention in an amount ranging from about 0.1 percent by weight to about 6.0 percent by weight, preferably from about 0.1 percent by weight to about 4.0 percent by weight, and more preferably from about 1.0 percent to about 3.0 percent by weight. Compositions having less than 0.1 percent by weight of the sulfur-containing compound when combined with the anti-wear component and the metallic component can provide reduced wear resistance. Compositions having over 6.0 percent by weight of the sulfur-containing compound can be less cost effective to manufacture.

The metallic component of the engine and lubricating oil of the present invention can include the oil-soluble neutral and basic salts of the alkaline earth metals of the Periodic Table (IUPAC) with sulfonic acids (sulfonates), carboxylic acids (carboxylates), or alkyl phenols (phenates). The term "basic salt," for purposes of the present invention, is used to designate metal salts wherein the metal is present in stoichiometrically larger amounts than the organic acid. Basic salts are preferred for use in the metallic component of the engine and lubricating oil of the present invention since basic salts can neutralize acidic components that can cause excessive wear to metal surfaces.

The metallic component of the engine and lubricating oil preferably includes the sulfonates, carboxylates, and phenates of alkaline earth metals represented by the general formula $(RSO_3)_2M$, $(RC_6H_4O)_2M$, and $(RCOO)_2M$ wherein M is the alkaline earth metal, and R is a hydrocarbon having a molecular weight of at least 160. R groups having a molecular weight of below 160 can result in a metallic component with reduced solubility in the engine and lubricating oil. It is further preferable that the R group comprise a paraffinic chain which can further improve the solubility of the metallic component in the engine and lubricating oil. Suitable metals for use in the metallic component of the engine and lubricating oil comprise the alkaline earth metals, preferably calcium, magnesium, strontium, and barium, and more preferably, calcium and magnesium. Calcium and magnesium are particularly preferred because they provide dispersant properties in addition to anti-wear benefits. A suitable metallic component of this type which comprises calcium sulfonate is AMOCO 366, manufactured by Amoco Petroleum Additives Company.

The metallic component is preferably present in the present invention in an amount of from about 0.1 percent by weight to about 6.0 percent by weight, preferably from about 0.1 percent by weight to about 4.0 percent by weight, and more preferably from about 1.0 percent by weight to about 3.0 percent by weight. Compositions having less than 0.1 percent by weight of the metallic component when combined with the anti-wear component and the sulfur-containing compound can provide reduced wear resistance. Compositions having over 6.0 percent by weight of the metallic component can be less cost effective to manufacture.

The lubricating base oil of the engine and lubricating oil of the present invention can include natural and synthetic lubricating oils and mixtures thereof. Natural oils can include animal, vegetable, and mineral oils, oils derived from coal or shale, as well as liquid petroleum oils. Petroleum based lubricating base oils can be derived from paraffinic, naphthenic, or mixed paraffinic and naphthenic type crude oils or feedstocks. Petroleum based feedstocks can be subjected to base oil preparation steps which can include fractionating by viscosity, solvent extracting, solvent or catalytically dewaxing, and hydroprocessing.

Synthetic lubricating oils can include hydrocarbon oils and halo-substituted hydrocarbon oils such as polymerized and interpolymerized olefins and esters of mono and dicarboxylic acids having molecular weights ranging from about 1000 to about 5000. Silicon-based oils such as polyalkyl-siloxane, polyaryl-siloxane, polyalkoxy-siloxane, polyaryloxy-siloxane, and liquid esters of phosphorus-containing acids are also suitable synthetic lubricating oil for use in the base oil of the engine and lubricating oil of the present invention. However, the presence of base oils containing esters of phosphorus-containing acids in engine and lubricating oils can reduce emissions system life in automotive use.

The preferred base oils for use in the engine and lubricating oil of the present invention are solvent extracted and dewaxed petroleum oils, hydroprocessed petroleum derived oils, and polyalphaolefins, and more preferably the solvent extracted and solvent or catalytically dewaxed petroleum derived oils. The lubricating base oil will generally comprise more than 50 percent by weight of the engine and lubricating oil, preferably more than 70 percent by weight, and more preferably more than 80 percent by weight.

The engine and lubricating oil of the present invention can include various additives. These additives can include dispersants, viscosity index improving agents, pour point depressing agents, anti-foam agents, rust-inhibiting agents, and oxidation and corrosion-inhibiting agents.

Dispersant additives can be provided in engine and lubricating oils to control sludge and varnish deposits in gasoline engines. Suitable dispersants for use in the engine and lubricating oil can include ashless (non-metallic) high molecular weight compounds characterized by a polar group attached to a relatively high molecular weight carbon chain. The polar group can contain nitrogen, oxygen, or phosphorus. However, phosphorus-containing dispersants can reduce emissions system life in automotive use. AMOCO 744, manufactured by Amoco Petroleum Additives Company, is an ashless dispersant suitable for use in the engine and lubricating oil of the present invention.

Viscosity index (VI) improver additives can be provided in engine and lubricating oils to improve the viscosity-temperature behavior in a lubricating oil. Improvements (increases) in VI result in a smaller change in oil viscosity with an increase in oil temperature. VI improver additives are generally oil soluble high molecular weight organic polymers. AMOCO 6565, manufactured by Amoco Petroleum Additives Company, is a VI improver suitable for use in the engine and lubricating oil of the present invention.

Pour point depressing agents can be provided in engine and lubricating oils to prevent congelation of an oil at low temperatures which is associated with the crystallization of paraffin wax which can be present in mineral oil fractions. Pour point depressing agents can include compounds such as alkylated wax naphthalene, polymethacrylates, and alkylated wax phenol. HITEC 672, manufactured by Ethyl Corporation, is a pour point depressing agent that is suitable for use in the engine and lubricating oil of the present invention.

The engine and lubricating oil of the present invention provides anti-wear protection superior to that of lubricating oils having conventional phosphorus-containing anti-wear components. The engine and lubricating oil achieves superior anti-wear protection by providing improved anti-oxidation capabilities and an improved wear protective layer. The improved anti-oxidation capabilities are achieved first, by the decomposition of hydroperoxides which prevents the direct oxidation of the engine and lubricating oil, and second, by the formation of an improved wear protective layer covering the lubricated metal surfaces.

The engine and lubricating oil provides an improved wear protective layer comprising substantially calcium and sulfur-containing components. The wear protective coating seals the metallic lubricating surface and provides a physical barrier to wear-induced equipment damage.

The wear protective layer provided through use of the engine and lubricating oil of the present invention provides wear protective layer deposits having sulfur chemical states more conducive to superior anti-wear performance than either the deposits produced from comparative oils or engine and lubricating oils without an anti-wear additive package. Sulfur components in the deposits generally found on lubricating surfaces can comprise elemental sulfur, sulfonate, sulfate, and sulfides among other components. Sulfur, in the form of sulfates and sulfide, is particularly preferred in the wear protective layer deposited on a lubricating surface.

The presence of sulfur in the form of sulfates and sulfides has been correlated to superior wear resistance in engine and lubricating oils. Sulfides, in the form of disulfides, can be absorbed on a metal surface where cleavage of the sulfur—sulfur bond can occur producing a metal thiolate (mercaptide) species. The metal thiolate species can provide improved metal wear protection (see S. Plaza, ASLE Transactions, Vol. 30, 4, pages 493-500).

The wear protective layer deposited on lubricating surfaces lubricated by the engine and lubricating oil of the present invention substantially comprises sulfates and sulfides which provide superior anti-wear protection to comparative engine and lubricating oil having ZDDP which can comprise sulfonates and engine and lubricating oils without an anti-wear package which can comprise elemental sulfur and sulfonates.

The engine and lubricating oil of the present invention is particularly resistant to general wear, and oscillating and pounding types of wear. The engine and lubricating oil of the present invention having benzotriazole or the reaction products of benzotriazole combined with a formaldehyde-containing component and an aliphatic amine, a sulfur-containing compound, and a metallic component, provides superior anti-wear properties to comparative engine and lubricating oils, and engine and lubricating oils without an anti-wear additive package. The anti-wear properties of the subject engine and lubricating oil, absent any of the above three components, can provide reduced anti-wear benefits.

The engine and lubricating oil of the present invention comprises an anti-wear package that is highly soluble in engine and lubricating base oils. Comparative lubricants, including lubricants having benzotriazole reacted directly with an aliphatic amine in the absence of formaldehyde, can result in the formation of organic salts that are less soluble in lubricating base oil and drop out of the lubricating oil. Insoluble anti-wear components can provide inferior engine and lubricating oil performance by forming undesireable engine deposits. Moreover, if a container of an engine and lubricating oil having a less soluble anti-wear component is not properly mixed prior to application of the oil to its intended use, the anti-wear additives can precipitate out of solution and be discarded with the container.

The engine and lubricating oil of the present invention achieves all of the above improvements without requiring the use of phosphorus-containing anti-wear additives that can reduce automotive emissions system life. Phorphorus components can reach an automotive emissions system from the direct combustion of engine and lubricating oils having a phosphorus-containing anti-wear additive, and from the entrainment in the combustion flue gas of previously deposited phosphorus-containing compounds that previously formed a lubricating surface wear protective layer. The subject engine oil prolongs emissions systems life by eliminating the need for the phosphorus source.

The engine and lubricating oil of the present invention is cost effective to manufacture compared to engine and lubricating oils comprising phosphorus-containing anti-wear components such as ZDDP. The benzotriazole or reaction product of benzotriazole combined with a formaldehyde-containing component and an aliphatic amine is generally a product of one reaction step. The addition of a sulfur-containing compound and a metallic component are simple mixing steps. The inexpensive manufacturing steps combined with the relatively small dosages of anti-wear component, sulfur-containing compound, and metallic component used with the lubricating base oil provide for a cost effective engine and lubricating oil with superior anti-wear properties.

The engine and lubricating oil of the present invention is described in further detail in connection with the following examples, it being understood that the same are for purposes of illustration and not limitation.

EXAMPLE 1

An amine derivative of benzotriazole (ADB) anti-wear component was prepared for use in the present anti-wear engine and lubricating oil. The ADB anti-wear additive was prepared by dissolving 1.9 g of benzotriazole in 10 ml of ethanol at room temperature. The mixture was combined with 0.36 g of formaldehyde, in the form of a 37 wt. % in water solution, and 2.41 g of dioctylamine, and stirred. The mixture was then heated and refluxed for 1 hr. and cooled with stirring to room temperature. The solvent was removed from the mixture using a rotary evaporator.

EXAMPLE 2

An engine and lubricating oil having ZDDP was prepared in a beaker by combining:

a) 30.00 percent by weight of a base oil comprising a petroleum-derived solvent extracted and dewaxed lubricating base oil having a viscosity of 4.20 CS at 100° C., a viscosity index of 95, and an API gravity of 31.6°;

b) 52.5 percent by weight of a base oil comprising a petroleum-derived solvent extracted and dewaxed lubricating base oil having a viscosity of 5.45 CS at 100° C., a viscosity index of 95, and a gravity of 31.0°; and c) 18.5 percent by weight of an additive package comprising 1.00 percent by weight zinc dialkyldithiophosphate (ZDDP) as a percentage of the engine and lubricating oil.

The engine and lubricating oil of Example 2, having ZDDP, was tested for wear protection using the Four Ball Wear Test (ASTM 4172). In the Four Ball Wear Test, a Falex Four-Ball Wear Test Machine was used. Three 12.7 mm diameter steel balls were clamped together and covered with the engine and lubricating oil. A fourth steel ball (12.7 mm in diameter) was rotated under a load of 40 kg on the three clamped balls. The temperature of the engine and lubricating oil was maintained at 200° F. and the top ball was rotated at 700 rpm for 60 min. The anti-wear performances of the engine and lubricating oil were compared by measuring the average size of the scar diameters worn on the three lower clamped balls. The results of the 4 Ball Wear Test are listed in Table 1.

The scar diameter of the 4 Ball Wear Test performed for Example 2 was 0.43 mm.

The engine and lubricating oil was tested for resistance to camshaft and lifter wear in engines from nitric acid produced from the reaction of nitrogen oxides with water in the engine blow-by. To determine this effect, a 0.01M solution of nitric acid in the engine and lubricating oil was prepared and subjected to the 4 Ball Wear Test described above. The results of the 4 Ball Wear Test are listed in Table 1.

The scar diameter of the 4 Ball Wear Test performed for Example 2 under blow-by conditions was 0.42 mm. The engine and lubricating oil of Example 2 functioned similarly under general and blow-by conditions.

EXAMPLE 3

An engine and lubricating oil having ADB was prepared in a beaker by combining:

a) 30.00 percent by weight of a base oil comprising a petroleum-derived solvent extracted and dewaxed lubricating base oil having a viscosity of 4.20 CS at 100° C., a viscosity index of 95, and an API gravity of 31.6°;

b) 52.50 percent by weight of a base oil comprising a petroleum-derived solvent extracted and dewaxed lubricating base oil having a viscosity of 5.45 CS at 100° C., a viscosity index of 95, and an API gravity of 31.0°;

c) 3.00 percent by weight of an ashless dispersant for controlling sludge and varnish deposits comprising a non-metal component containing a polar group attached to a high molecular weight carbon chain (AMOCO 744 manufactured by Amoco Petroleum Additives Company);

d) 2.00 percent by weight of a sulfur-containing compound comprising sulfurized alkyl oleate (AMOCO 130, manufactured by Amoco Petroleum Additives Company);

e) 2.00 percent by weight of a metallic component comprising a high base calcium sulfonate (AMOCO 366, manufactured by Amoco Petroleum Additives Company);

f) 9.25 percent by weight of a viscosity index improver comprising an oil soluble high molecular weight organic polymer (AMOCO 6565, manufactured by Amoco Petroleum Additives Company);

g) 0.25 percent by weight of a polymeric pour point depressant comprising an alkylated wax naphthalene (Hites 672, manufactured by Ethyl Corporation); and h) 1.00 percent by weight of ADB as described in Example 1.

The engine and lubricating oil of Example 3, having ADB, was subjected to the 4 Ball Wear test described in Example 2. The results of the 4 Ball Wear Test are listed in Table 1.

The scar diameter of the 4 Ball Wear Test performed for Example 3 was 0.33 mm which is substantially lower and more favorable than the scar diameter of the engine and lubricating oil of Example 2 having ZDDP.

The engine and lubricating oil of Example 3 was tested under blow-by conditions using the 4 Ball Wear Test with nitric acid described in Example 2. The results of the 4 Ball Wear Test are listed in Table 1.

The scar diameter of the 4 Ball Wear Test under blow-by conditions increased to 0.42 mm. The engine and lubricating oil of Example 3 having ADB achieves general performance superior to that of the engine and lubricating oil of Example 2 having ZDDP. The engine and lubricating oils of Examples 2 and 3 perform similarly under blow-by conditions.

EXAMPLE 4

An engine and lubricating oil absent ADB and ZDDP was prepared in a manner similar to Example 3, except that the base oil of step (a) comprising a petroleum-derived solvent extracted and dewaxed lubricating base oil having a viscosity of 4.20 CS at 100° C. was increased to 31.00 percent by weight and the ADB of step (h) was eliminated.

The engine and lubricating oil of Example 4, absent ADB and ZDDP, was subjected to the 4 Ball Wear Test described in Example 2. The results of the 4 Ball Wear Test are listed in Table 1.

The scar diameter of the 4 Ball Wear Test performed for Example 4 was 0.43 mm which is similar to the results achieved using the ZDDP-containing engine and lubricating oil of Example 2 and inferior to the results achieved using the ADB-containing engine and lubricating oil of Example 3.

The engine and lubricating oil of Example 4 was tested under blow-by conditions using the 4 Ball Wear Test with nitric acid described in Example 2. The results of the 4 Ball Wear Test are listed in Table 1.

The scar diameter of the 4 Ball Wear test under blow-by conditions increased substantially to 0.56 mm. The engine and lubricating oil of Example 4, absent ADB and ZDDP, achieves inferior performance to both the engine and lubricating oil of Example 2 having ZDDP, and the engine and lubricating oil of Example 3 having ADB, under blow-by conditions.

EXAMPLE 5

An engine and lubricating oil having a commercial benzotriazole derivative copper corrosion inhibitor and passivator was prepared in a manner similar to Example 3, except that the ADB of step (h) was replaced in the blend by a commercial benzotriazole derivative copper corrosion inhibitor and passivator (Reomet 39, manufactured by CIBA-GEIGY).

The engine and lubricating oil of Example 5 was subjected to the 4 Ball Wear Test described in Example 2. The results of the 4 Ball Wear Test are listed in Table 1.

The scar diameter of the 4 Ball Wear Test performed for Example 5 was 0.36 mm which is substantially lower and more favorable than the scar diameter of the engine and lubricating oil of Example 2 having ZDDP, and slightly higher and less favorable than the engine and lubricating oil of Example 3 having ADB.

The engine and lubricating oil of Example 5 was tested under blow-by conditions using the 4 Ball Wear Test with nitric acid described in Example 2. The results of the 4 Ball Wear Test are listed in Table 1.

The scar diameter of the 4 Ball Test under blow-by conditions increased to 0.46 mm. The engine and lubricating oil of Example 5 having Reomet 39 achieves performance slightly inferior to that of the engine and lubricating oil of Example 2 having ZDDP and that of the engine and lubricating oil of Example 3 having ADB under blow-by conditions.

EXAMPLE 6

An engine and lubricating oil absent a suitable metallic component was prepared in a manner similar to Example 3, except that the base oil of step (a) comprising a petroleum-derived solvent extracted and dewaxed lubricating base oil having a viscosity of 4.2 CP at 100° C. was increased to 32 percent by weight and the AMOCO 366 metallic component of step (e) was eliminated.

The engine and lubricating oil of Example 6, without a suitable metallic component, was subjected to the 4 Ball Wear Test described in Example 2. The results of the 4 Ball Wear Test are listed in Table 1.

The scar diameter of the 4 Ball Wear Test performed for Example 6 was 0.41 mm which is substantially larger and less favorable than the results achieved in Example 3 having ADB and a suitable metallic component. Removing the metallic component from the engine and lubricating oil having ADB can result in reduced anti-wear properties.

EXAMPLE 7

An engine and lubricating oil absent a suitable sulfur-containing compound was prepared in a manner similar to Example 3, except that the base oil of step (a) comprising a petroleum-derived solvent extracted and dewaxed lubricating base oil having a viscosity of 4.2 CP at 100° C. was increased to 32 percent by weight and the AMOCO 130 sulfur-containing compound of step (d) was eliminated.

The engine and lubricating oil of Example 7, without a suitable sulfur-containing compound, was subjected to the 4 Ball Wear Test described in Example 2. The results of the 4 Ball Wear Test are listed in Table 1.

The scar diameter of the 4 Ball Wear Test performed for Example 7 was 0.40 mm which is substantially larger and less favorable than the results achieved in Example 3 having ADB and a suitable sulfur-containing compound. Removing the sulfur-containing compound from the engine and lubricating oil having ADB can result in reduced anti-wear properties.

ZDDP described in Example 8. The maximum load before failure average of the two runs was 950N, substantially higher than the engine and lubricating oil described in Example 8 having ZDDP illustrating that the engine and lubricating oil having ZDDP can be more likely to seize under oscillatory and pounding type wear than an engine and lubricating oil absent ZDDP.

TABLE 1

4-BALL WEAR TEST RESULTS

| | EXAMPLES | | | | | |
|---|---|---|---|---|---|---|
| | 2 | 3 | 4 | 5 | 6 | 7 |
| ENGINE AND LUBRICATING OIL COMPOSITION-WT% | | | | | | |
| LUBRICATING BASE OIL 4.20 CS @ 100° C. VISCOSITY | 30.00 | 30.00 | 31.00 | 30.00 | 32.00 | 32.00 |
| LUBRICATING BASE OIL 5.45 CS @ 100° C. VISCOSITY | 52.50 | 52.50 | 52.50 | 52.50 | 52.50 | 52.50 |
| ADDITIVE PACKAGE-1% ZDDP AS A PERCENTAGE OF ENGINE AND LUBRICATING OIL | 18.50 | | | | | |
| AMOCO 744-ASHLESS DISPERSANT | | 3.00 | 3.00 | 3.00 | 3.00 | 3.00 |
| AMOCO 130-SULFUR-CONTAINING COMPOUND | | 2.00 | 2.00 | 2.00 | 2.00 | |
| AMOCO 366-METALLIC COMPONENT | | 2.00 | 2.00 | 2.00 | | 2.00 |
| AMOCO 6565-VISCOSITY INDEX IMPROVER | | 9.25 | 9.25 | 9.25 | 9.25 | 9.25 |
| HITEC 672-POUR POINT DEPRESSANT | | 0.25 | 0.25 | 0.25 | 0.25 | 0.25 |
| ADB-EXAMPLE 1 | | 1.00 | | | 1.00 | 1.00 |
| CIBY-GEIGY-REOMET 39 | | | | 1.00 | | |
| 4-BALL WEAR TEST SCAR DIAMETER-MM | 0.43 | 0.33 | 0.43 | 0.36 | 0.41 | 0.40 |
| 4-BALL WEAR TEST WITH NITRIC ACID SCAR DIAMETER-MM | 0.42 | 0.42 | 0.56 | 0.46 | | |

EXAMPLE 8

The engine and lubricating oil of Example 2 having ZDDP was tested to determine wear resistance to oscillating and pounding type of wear. The test was performed using an Optimol SRV (Schwingung, Reibung, Verschleiss) Friction Wear Testing Device. The apparatus for the test consisted of a clean 10 mm steel ball made of 52100 steel (German designation) with a Rockwell hardness ($R_c$) of 60–63 placed on top of a steel disk plate. A drop of the engine and lubricating oil of Example 2 was placed between the disk plate and the steel ball, and a means was applied to the steel ball to oscillate the steel ball horizontally against the steel plate at a frequency of 50 Hz and a stroke amplitude of 1 mm. The oscillating force applied to the steel ball was increased in increments of 100N and the coefficient friction was measured. The maximum force load was also measure at the load where the steel ball and the disk plate seized. Two runs were made to determine the maximum load before failure and the average of the two runs was calculated. The results of the Optimol SRV Stepload Test are listed in Table 2.

The coefficient of friction for the engine and lubricating oil of Example 2 having ZDDP was 0.13. The maximum load before failure average of the two runs was 400N.

EXAMPLE 9

The engine and lubricating oil of Example 4 absent ADB and ZDDP was tested to determine wear resistance to oscillating and pounding type of wear. The Optimol SRV Stepload Test was performed according to the procedure described in Example 8. The results of the Optimol SRV Stepload Test are listed in Table 2.

The coefficient of friction for the engine and lubricating oil of Example 4 absent ADB and ZDDP was 0.12, a result similar to the engine and lubricating oil having

EXAMPLE 10

The engine and lubricating oil of Example 3 having ADB was tested to determine wear resistance to oscillating and pounding type of wear. The Optimol SRV Stepload Test was performed according to the procedure described in Example 8. The results of the Optimol SRV Stepload Test are listed in Table 2.

The coefficient of friction for the engine and lubricating oil of Example 3 having ADB was 0.12, a result similar to the engine and lubricating oil having ZDDP described in Example 8 and the engine and lubricating oil absent ADB and ZDDP described in Example 9. The maximum load before failure average of the two runs was 1150N, substantially higher than the engine and lubricating oil described in Example 8 having ZDDP and somewhat higher than the engine and lubricating oil described in Example 9 absent ADB and ZDDP illustrating that the engine and lubricating oil having ADB provides superior resistance to oscillatory and pounding type wear.

EXAMPLE 11

The engine and lubricating oil of Example 2 having ZDDP was tested to determine wear resistance to oscillating and pounding type wear using the same Optimol SRV Stepload Testing Apparatus described in Example 8. In this test, the oscillating force applied to the steel ball was held constant, a first run was made at 100N and a second run was made at 200N. Each test was performed for a 1 hr. period. The coefficient of friction and the scar diameter for the steel ball and for the steel disk plate were measured. The results of the Optimol SRV Wear Test are listed in Table 2.

The coefficient of friction for the engine and lubricating oil of Example 2 having ZDDP for the 100N oscillatory force was 0.14. The disk plate scar diameter was 0.45 mm and the steel ball scar diameter was 0.50 mm.

The coefficient of friction for the 200N oscillatory force was 0.14. The disk plate scar diameter was 0.66 mm and the steel ball scar diameter was 0.65 mm.

EXAMPLE 12

The engine and lubricating oil of Example 4 absent ADB and ZDDP was tested to determine wear resistance to oscillating and pounding type wear using the Optimol SRV Wear Test described in Example 11. The results of the Optimol SRV Wear Test are listed in Table 2.

The coefficient of friction for the engine and lubricating oil of Example 4 absent ADB and ZDDP for the 100N oscillatory force was 0.12, which is slightly lower than the coefficient of friction for the engine and lubricating oil having ZDDP described in Example 11. The disk plate scar diameter was 0.36 mm and the steel ball scar diameter was 0.33 mm, both substantially lower than the scar diameters of the engine and lubricating oil having ZDDP described in Example 11.

The coefficient of friction for the 200N oscillatory force was 0.12, which is slightly lower than the coefficient of friction for the engine and lubricating oil having ZDDP described in Example 11. The disk plate scar diameter was 0.39 mm and the steel ball scar diameter was 0.36 mm, both substantially lower than the scar diameters of the engine and lubricating oil having ZDDP described in Example 11.

EXAMPLE 13

The engine and lubricating oil of Example 3 having ADB was tested to determine wear resistance to oscillating and pounding type wear using the Optimol SRV Wear Test described in Example 11. The results of the Optimol SRV Wear Test are listed in Table 2.

The coefficient of friction for the engine and lubricating oil of Example 3 having ADB for the 100N oscillatory force was 0.12, which is similar to the coefficient of friction for the engine and lubricating oil absent ADB and ZDDP described in Example 12 and superior to the engine and lubricating oil having ZDDP described in Example 11. The disk plate scar diameter was 0.30 mm and the steel ball scar diameter was 0.30 mm, both substantially lower than the scar diameters of the engine and lubricating oil having ZDDP described in Example 11 and the engine and lubricating oil absent ADB and ZDDP described in Example 12.

The coefficient of friction for the 200N oscillatory force was 0.12, which is similar to the coefficient of friction for the engine and lubricating oil absent ADB and ZDDP described in Example 12 and superior to the coefficient of friction for the engine and lubricating oil having ZDDP described in Example 11. The disk plate scar diameter was 0.36 mm and the steel ball scar diameter was 0.36 mm, both substantially lower than the scar diameters of the engine and lubricating oil having ZDDP described in Example 11 and slightly lower than the engine and lubricating oil absent ADB and ZDDP described in Example 12.

TABLE 2

| OPTIMOL SRV TESTING RESULTS | EXAMPLE | | | | | |
|---|---|---|---|---|---|---|
| | 8 | 9 | 10 | 11 | 12 | 13 |
| ENGINE AND LUBRICATING OIL EXAMPLE SOURCE | 2 | 4 | 3 | 2 | 4 | 3 |
| STEPLOAD WEAR TEST | | | | | | |
| COEFFICIENT OF FRICTION | 0.13 | 0.12 | 0.12 | | | |
| MAXIMUM FAILURE LOAD-NEWTONS | 400 | 950 | 1150 | | | |
| WEAR TEST-100 NEWTONS | | | | | | |
| COEFFICIENT OF FRICTION | | | | 0.14 | 0.12 | 0.12 |
| DISK SCAR DIAMETER-MM | | | | 0.45 | 0.36 | 0.30 |
| BALL SCAR DIAMETER-MM | | | | 0.50 | 0.33 | 0.30 |
| WEAR TEST-200 NEWTONS | | | | | | |
| COEFFICIENT OF FRICTION | | | | 0.14 | 0.12 | 0.12 |
| DISK SCAR DIAMETER-MM | | | | 0.66 | 0.39 | 0.36 |
| BALL SCAR DIAMETER-MM | | | | 0.65 | 0.36 | 0.36 |

EXAMPLE 14

The species present on the surface of the disk plate wear scars from the Optimol SRV Wear Test of Example 11 using the engine and lubricating oil of Example 2 having ZDDP were tested to further determine what comprised the wear protective layer. The instrument used for the analysis was an SSX-100 X-ray Photo electron Spectrometer (XPS) manufactured by Surface Science Instruments. The XPS impinges hard X-rays on the surface of a sample and measures the kinetic energy of emitted electrons characteristic of the species on the surface of the sample. The XPS was used to determine the atomic ratios of sulfur to iron, calcium to iron, phosphorus to iron, and zinc to iron. The results of the X-ray Photoelectron Spectroscopy Surface Analyses are illustrated in FIG. 1.

The engine and lubricating oil having ZDDP tested in Example 11 produced a wear protective layer comprising phosphorus, calcium, sulfur, and zinc with phosphorus being the predominant species followed by zinc. This indicates that the wear protective layer is composed predominantly of the decomposition products of ZDDP.

EXAMPLE 15

The species present on the surface of the disk plate wear scars from the Optimol SRV Wear Test of Example 12 using the engine and lubricating oil of Example 4 absent ADB and ZDDP were tested to further determine what comprised the wear protective layer. The test was conducted according to the procedure described in Example 14. The results are illustrated in FIG. 1.

The engine and lubricating oil absent ADB and ZDDP tested in Example 12 produced a wear protective layer comprising calcium and sulfur. The amount of deposits recovered from the scar area were substantially less than the deposits recovered from the scar area in Example 14.

EXAMPLE 16

The species present on the surface of the disk plate wear scars from the Optimol SRV Wear Test of Example 13 using the engine and lubricating oil of Example 3 having ADB were tested to further determine what comprised the wear protective layer. The test was conducted according to the procedure described in Example 14. The results are illustrated in FIG. 1.

The engine and lubricating oil having ADB tested in Example 13 produced a wear protective layer comprising calcium and sulfur. The amount of calcium on the surface of the scar was about double that of the scar deposits caused by the engine and lubricating oil having ZDDP of Example 11. The sulfur deposits were similar for the scar deposits of Examples 11 and 13. The overall amount of scar deposits for the engine and lubricating oil of Example 13 having ADB was similar to the amount of deposits for the engine and lubricating oil of Example 11 having ZDDP, and substantially greater than the amount of deposits for the engine and lubricating oil absent ADB and ZDDP indicating that the engine and lubricating oil without ADB and ZDDP provides a reduced wear protective layer.

EXAMPLE 17

The species present on the surface of the disk plate wear scars from the Optimol SRV Wear Test of Example 11 using the engine and lubricating oil of Example 2 having ZDDP were tested to further determine the particular sulfur components present in the wear protective layer. The instrument used for the analysis was the SSX-100 X-ray Photo-electron Spectrometer described in Example 14. The particular sulfur component chemical states are listed in Table 3.

The engine and lubricating oil having ZDDP tested in Example 11 produced a wear protective layer sulfur component present as 84 percent by weight of total sulfur sulfide and 16 percent by weight of total sulfur sulfonate. Since high sulfide and sulfate concentrations are correlated to reduced wear, the engine and lubricating oil of Example 2 having ZDDP provides a favorable mix of wear protective layer sulfur chemical states.

EXAMPLE 18

The species present on the surface of the disk plate wear scars from the Optimol SRV Wear Test of Example 12 using the engine and lubricating oil of Example 4 absent ADB and ZDDP were tested to further determine the particular sulfur components present in the wear protective layer. The test was conducted in a manner similar to Example 17. The results are listed in Table 3.

The engine and lubricating oil absent ZDDP tested in Example 12 produced a wear protective layer sulfur component present as 27 percent by weight of total sulfur sulfide, 32 percent by weight of total sulfur elemental sulfur, and 41 percent by weight of total sulfur sulfonate. The engine and lubricating oil of Example 4 absent ADB and ZDDP provides a substantially less favorable mix of wear protective layer sulfur chemical states than the engine and lubricating oil having ZDDP of Example 2.

EXAMPLE 19

The species present on the surface of the disk plate wear scars from the Optimol SRV Wear Test of Example 13 using the engine and lubricating oil of Example 3 having ADB were tested to further determine the particular sulfur components present in the wear protective layer. The test was conducted in a manner similar to Example 17. The results are listed in Table 3.

The engine and lubricating oil having ADB tested in Example 13 produced a wear protective layer sulfur component present as 82 percent by weight of total sulfur sulfide and 18 percent by weight of total sulfur sulfate. The engine and lubricating oil of Example 3 having ADB provides a superior mix of wear protective layer sulfur chemical states to the engine and lubricating oil having ZDDP of Example 2 and the engine and lubricating oil absent ADB and ZDDP of Example 4.

TABLE 3

| WEAR PROTECTIVE LAYER SULFUR CHEMICAL STATE | EXAMPLE | | |
|---|---|---|---|
| | 17 | 18 | 19 |
| ENGINE AND LUBRICATING OIL EXAMPLE SOURCE | 2 | 4 | 3 |
| SULFUR CHEMICAL STATES | | | |
| SULFIDE | 84 | 27 | 82 |
| SULFATE | | | 18 |
| SULFONATE | 16 | 41 | |
| SULFUR (ELEMENTAL) | | 32 | |

That which is claimed is:

1. An anti-wear engine and lubricating oil comprising:

a base oil;

an anti-wear component comprising the Mannich products of benzotriazole or the reaction products of benzotriazole, with formaldehyde and at least one aliphatic amine selected from the group consisting of primary or secondary amines and present in a concentration ranging from about 0.1 percent to about 4.0 percent by weight of said lubricating oil;

a sulfur-containing compound comprising at least one member selected from the group consisting of sulfurized olefinic compounds having from about 3 to about 30 carbon atoms, organic sulfides, and polysulfides wherein said sulfur-containing compounds is present in a concentration ranging from about 0.1 percent to about 4.0 percent by weight of said lubricating oil; and a metallic component having at least one member selected from the group consisting of calcium, magnesium, strontium and barium and present in a concentration ranging from about 0.1 percent to about 4.0 percent by weight of said lubricating oil.

2. The anti-wear engine and lubricating oil of claim 1 wherein said anti-wear component comprises an unsubstituted benzotriazole or a reaction product of an unsubstituted benzotriazole.

3. The anti-wear engine and lubricating oil of claim 1 wherein said aliphatic amine comprises at least one alkyl group having more than 7 carbon atoms.

4. The anti-wear engine and lubricating oil of claim 1 wherein said metallic component comprises at least one member selected from the group consisting of calcium and magnesium.

5. The anti-wear engine and lubricating oil of claim 1 wherein said aliphatic amine is dioctylamine.

6. An anti-wear engine and lubricating oil comprising:

a base oil;

an anti-wear component having the formula

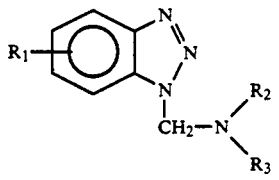

wherein $R_1$ is a member selected from the group consisting of hydrogen and alkyl, $R_2$ is a member selected from the group consisting of hydrogen and alkyls having from 1 to 30 carbon atoms, and $R_3$ is a member selected from the group consisting of alkyls having from 1 to 30 carbon atoms, said anti-wear component present in a concentration ranging from about 0.1 percent to about 4.0 percent by weight of said lubricating oil;

a sulfurized olefinic component having from about 3 to about 30 carbons atoms and present in a concentration ranging from about 0.1 percent to about 4.0 percent by weight of said lubricating oil; and a metallic component having at least one member selected from the group consisting of calcium and magnesium and present in a concentration ranging from about 0.1 percent to about 4.0 percent by weight of said lubricating oil;

7. The anti-wear engine and lubricating oil of claim 6 wherein said base oil is at least one member selected from the group consisting of solvent extracted and dewaxed petroleum oils, hydroprocessed petroleum derived oils, and polyalphaolefins.

8. The anti-wear engine and lubricating oil of claim 6 wherein $R_1$ comprises at least one member selected from the group consisting of hydrogen and tolyl.

9. The anti-wear engine and lubricating oil of claim 8 wherein said anti-wear component is present in said engine oil in an amount ranging from about 0.1 percent by weight to about 2.0 percent by weight.

10. The anti-wear engine and lubricating oil of claim 6 wherein $R_2$ and $R_3$ comprise the same alkyl group, said alkyl group containing from about 10 to about 30 carbon atoms.

11. The anti-wear engine and lubricating oil of claim 6 wherein $R_2$ and $R_3$ are the same or different members selected from the group consisting of an alkyl group having from about 4 to about 18 carbon atoms, a cycloalkyl group, and a cycloalkyl group having a hydrocarbon side chain having at least 2 carbon atoms.

12. The anti-wear engine and lubricating oil of claim 6 wherein said sulfurized olefinic component comprises an olefin defined by the formula $R_4R_5=R_6R_7$ wherein $R_4$, $R_5$, $R_6$, and $R_7$ are the same or different members selected from the group consisting of hydrogen, alkyl, and alkenyl.

13. The anti-wear engine and lubricating oil of claim 6 wherein said metallic component comprises a member selected from the group consisting of $(RSO_3)_2M$, $(RC_6H_4O)_2M$ and $(RCOO)_2M$, wherein R is a hydrocarbon having a molecular weight of at least 160, and M comprises at least one member selected from the group consisting of calcium and magnesium.

14. The anti-wear engine and lubricating oil of claim 6 wherein said aliphatic amine is dioctylamine.

15. An anti-wear engine and lubricating oil comprising:

a base oil;

an anti-wear component comprising the Mannich products of at least one component selected from the group consisting of benzotriazole, tolylbenzotriazole, 4-methylbenzotriazole, and 5-methylbenzotriazole, reacted with formaldehyde and an aliphatic monoamine selected from the group consisting of primary and secondary amines, said anti-wear component present in an amount ranging from about 0.1 percent by weight to about 2.0 percent by weight;

a sulfur-containing olefinic compound having from about 3 to about 20 carbon atoms and present in an amount ranging from about 0.1 percent by weight to about 4.0 percent by weight; and a metallic component having at least one member selected from the group consisting of calcium and magnesium and present in an amount ranging from about 0.1 percent by weight to about 4.0 percent by weight.

16. The anti-wear engine and lubricating oil of claim 15 wherein said base oil comprises at least one member selected from the group consisting of solvent extracted and dewaxed petroleum oils, hydroprocessed petroleum derived oils, and polyalphaolefins.

17. The anti-wear engine and lubricating oil of claim 15 wherein said anti-wear component comprises at least one member selected from the group consisting of 4-methylbenzotriazole and 5-methylbenzotriazole.

18. The anti-wear engine and lubricating oil of claim 15 wherein said aliphatic monoamine comprises at least one member selected from the group consisting of the aliphatic secondary monoamines.

19. The anti-wear engine and lubricating oil of claim 15 wherein said aliphatic monoamine comprises at least one member selected from the group consisting of dioctylamine, dinonylamine, and didecylamine.

20. The anti-wear engine and lubricating oil of claim 15 wherein said anti-wear component is present in an amount ranging from about 0.5 percent by weight to about 1.5 percent by weight.

21. The anti-wear engine and lubricating oil of claim 15 wherein said sulfur-containing olefinic compound is present in an amount ranging from about 1.0 percent by weight to about 3.0 percent by weight.

22. The anti-wear engine and lubricating oil of claim 15 wherein said metallic component comprises a member selected from the group consisting of $(RSO_3)_2M$, $(RC_6H_4O)_2M$, and $(RCOO)_2M$ wherein R is a hydrocarbon having a molecular weight of at least 160, and M comprises at least one member selected from the group consisting of calcium and magnesium.

23. The anti-wear engine and lubricating oil of claim 15 wherein said metallic component comprises at least one member selected from the group consisting of $(RSO_3)_2M$, where R is a hydrocarbon having a molecular weight of at least 160, and M is at least one member selected from the group consisting of calcium and magnesium.

24. The anti-wear engine and lubricating oil of claim 15 wherein said metallic component is present in an amount ranging from about 1.0 percent by weight to about 3.0 percent by weight.

25. The anti-wear engine and lubricating oil of claim 15 wherein said aliphatic monomine is dioctlyamine.

* * * * *